US006379239B1

(12) United States Patent
Sugai et al.

(10) Patent No.: US 6,379,239 B1
(45) Date of Patent: Apr. 30, 2002

(54) DEVICE FOR COUNTING COINS OR THE LIKE

(75) Inventors: Katsumi Sugai, Nagoya; Nobuyuki Nakatani, Himeji; Masanari Nakamura, Shiojiri, all of (JP)

(73) Assignees: Sugai General Industries Ltd., Nagoya; Wing Design Co., PREV., Himeji, both of (JP)

( * ) Notice: Subject to any disclaimer, the term of this patent is extended or adjusted under 35 U.S.C. 154(b) by 0 days.

(21) Appl. No.: 09/485,494

(22) PCT Filed: Jun. 10, 1999

(86) PCT No.: PCT/JP99/03139

§ 371 Date: Feb. 11, 2000

§ 102(e) Date: Feb. 11, 2000

(87) PCT Pub. No.: WO99/66457

PCT Pub. Date: Dec. 23, 1999

(30) Foreign Application Priority Data

Jun. 15, 1998 (JP) ..... 10-167057

(51) Int. Cl.[7] ..... G07D 1/00; G07D 5/02

(52) U.S. Cl. ..... 453/32; 453/3; 453/4; 453/7; 453/11; 194/334

(58) Field of Search ..... 453/3, 4, 7, 11, 453/32; 194/334

(56) References Cited

U.S. PATENT DOCUMENTS

| | | | | | |
|---|---|---|---|---|---|
| 3,998,237 | A | * | 12/1976 | Kressin et al. | 453/6 |
| 4,172,462 | A | * | 10/1979 | Uchida et al. | 453/6 |
| 4,442,850 | A | * | 4/1984 | Austin et al. | 453/32 X |
| 4,531,625 | A | * | 7/1985 | Yonekura et al. | 194/334 |
| 4,681,204 | A | * | 7/1987 | Zimmermann | 453/32 X |
| 5,076,414 | A | * | 12/1991 | Kimoto | 453/32 X |
| 5,366,407 | A | * | 11/1994 | Sentoku | 453/3 |
| 5,538,468 | A | * | 7/1996 | Ristvedt et al. | 453/3 |
| 5,607,351 | A | * | 3/1997 | Schwartz | 453/32 |
| 6,030,284 | A | * | 2/2000 | Frank | 453/3 |

FOREIGN PATENT DOCUMENTS

| | | | | |
|---|---|---|---|---|
| FR | 2335006 | * | 7/1977 | 453/32 |
| GB | 2208738 | * | 7/1977 | 453/32 |
| JP | 2-95470 U | | 7/1990 | |
| JP | 2523391 B2 | | 5/1996 | |

* cited by examiner

*Primary Examiner*—Janice L. Krizek
*Assistant Examiner*—Thuy V. Tran
(74) *Attorney, Agent, or Firm*—Armstrong, Westerman & Hattori, LLP

(57) ABSTRACT

Unassorted tokens of different types are supplied into a coin inlet portion 16 of an upper casing 3, so that the numbers of respective types or total amount of discharged tokens are calculated and displayed.

A rotary disk 5 and a disk follower 6 are arranged at an upper surface of a main case 2, with a belt 12 extending around their circumferences, so that they are rotated by a handle 14. An upper casing 3 is attached to the main case 2 in a manner enabling opening and closing movement. A lower surface of the upper casing 3 is formed with a guide passage 19. The upper casing 3 is provided with detection holes 23 above which a coin sensor is provided that is capable of calculating the diameters and transit number of tokens. The main case 2 is provided with a light source from which light is emitted for irradiating the coin sensor. The supplied tokens are shifted from the outer edge of the rotating rotary disk 5 onto the belt 12 in the guide passage 19. These tokens are detected by the coin sensor before they are discharged from an outlet 11. The results such as the number and amount of money, which are calculated by a controller, are displayed by an LED display unit arranged in the upper surface of the upper casing 3.

9 Claims, 9 Drawing Sheets

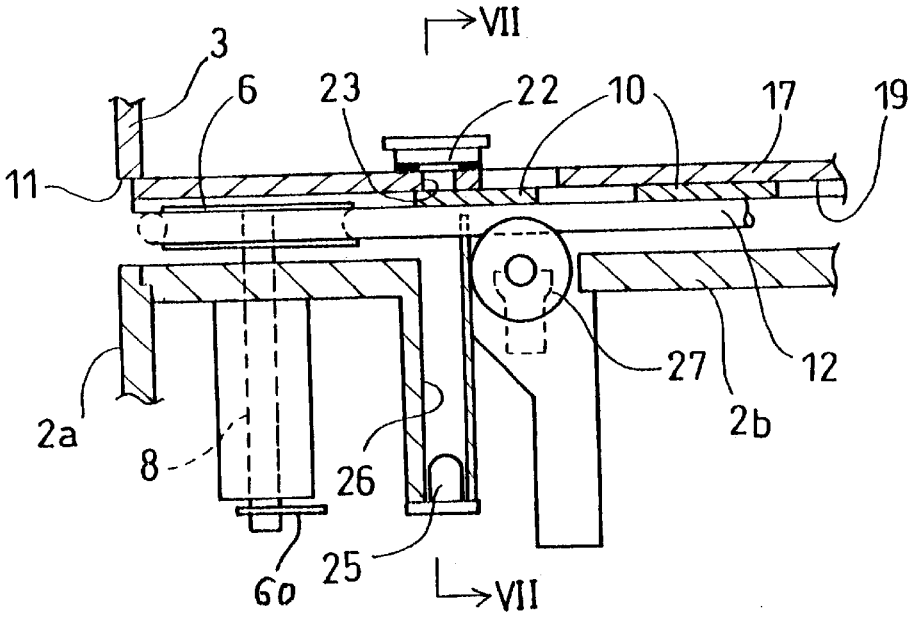
Fig. 6
Fig. 7
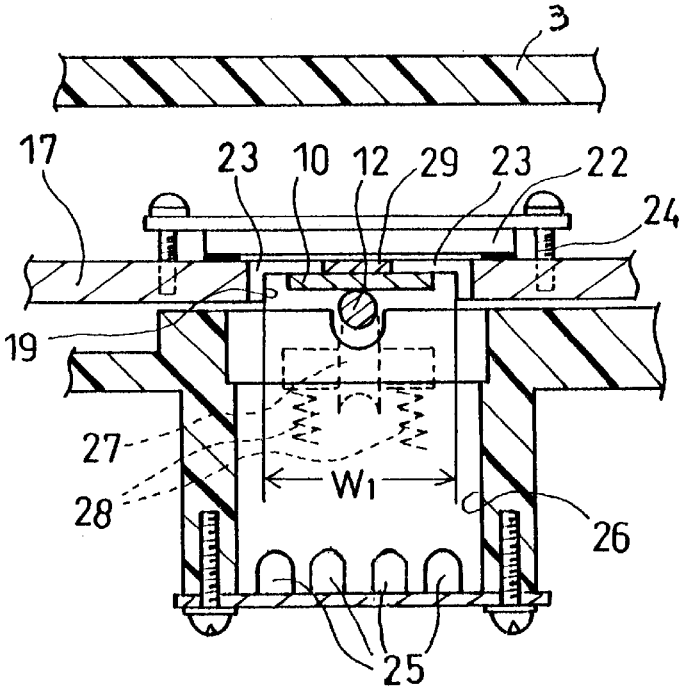

Display Unit
56
56a
Amount/Number Display 7-Segment LED
56b
Type-Displaying LED
57
Operation Switch
22
Coin Sensor (CCD)
55
Drive Circuit Length-Measuring Circuit
50
Controller
52
Power Source
Light Source Projector LED
25
Drive Circuit
54
Switch
53
Rotation Direction Sensor
58

DEVICE FOR COUNTING COINS OR THE LIKE

TECHNICAL FIELD

The present invention relates to a token counter for calculating the types and amount of tokens such as monetary coins or coin-shaped medals used for various game machines.

BACKGROUND ART

According to a conventional token counter, a plurality of unassorted tokens having different face values and diameters may be put into the counter together, and caused to pass through a gate member. Then, the passed tokens are counted and discharged. The gate member is arranged to allow the passage of tokens having a particular diameter and thickness. Thus, tokens having a larger diameter or thickness are made to remain in the holding portion for the supplied coins. The gate member is size-adjustable to deal with the diameters and thicknesses of the coins.

However, when unassorted tokens of several types are put together into the supply section, the adjustment of the gate member needs to be started from a smaller dimension corresponding to a smaller diameter, so that tokens of a smaller diameter will be counted and discharged before larger ones. Otherwise, the tokens of smaller diameters will unduly be discharged from the gate member adjusted to allow passage of diametrically large tokens, and this causes a problem of erroneous calculations. In addition, the calculation procedure needs to be repeated as many times as the gate member is adjusted (for example, the number of types of Japanese coins), which is problematically troublesome and time-consuming.

The above problems are addressed by prior art, for instance, National Publication No. 9-500468 (International Application Number: PCT2/US94/08036; International Publication Number: WO95/049789). According to this, a coin-sorting apparatus is provided which includes a rotary disk having an elastic upper surface, a stationary sorting head having a lower surface which is arranged in parallel to but slightly spaced from the upper surface of the rotary disk, and a drive motor for driving the rotary disk. The stationary sorting head are provided, at a lower portion thereof, with a gauge passage for arranging tokens (coins) of various types (diameters) into a single row and single layer, and with a plurality of spiral coin sorting passages which communicate with the gauge passage and are arranged to receive and discharge tokens (coins) of particular types (diameters) at positions downstream of the flow of the arranged tokens.

Although the above apparatus is capable of sorting tokens of different types (diameters), it cannot calculate the numbers or total amount of the tokens.

SUMMARY OF INVENTION

The present invention has been proposed for overcoming the above problems, and its object is to provide a token counter which makes it possible to display the total amount of money for all of the tokens (coins) discharged from the apparatus, even if the supplied tokens include various types in an unassorted state. It is also possible to display each of the numbers or/and amounts for the respective types of the discharged tokens. Further, the discharging operation (counting operation) of the tokens from the apparatus needs to be performed only once.

According to a first aspect of the present invention, there is provided a token counter comprising: a rotary disk whose upper surface is arranged to support tokens and which is rotated manually or by driving means; a disk follower arranged outwardly from the rotary disk; an endless transfer member extending around circumferences of the rotary disk and the disk follower; a guide plate provided with a token inlet portion open to the upper surface of the rotary disk and with a guide passage for guiding tokens so that they are discharged toward an outlet, the tokens being carried on the endless transfer member moving from a circumferential side portion of the rotary disk toward a side of the disk follower; a coin sensor for detecting diameters and transit number of the tokens being transferred in the guide passage; a control unit for calculating measurement results obtained by the coin sensor; and a display unit for displaying calculated results such as amount of money of the discharged tokens.

With such an arrangement, when the rotary disk is rotated in the forward direction after a plurality of tokens of different types are supplied onto the rotary disk via the coin inlet portion, the tokens are introduced, one by one, into the guide passage from the outer edge of the rotary disk. Then, the tokens are placed on the endless transfer member moving along the guide passage and transferred in the direction of the outlet. On the way, the coin sensor detects the diameters and numbers of the respective tokens being transferred. The detection results are calculated by the control unit to be automatically displayed.

Further, with the above arrangement, even if a lot of tokens of various face values are supplied in an unassorted manner, the types and the numbers of the tokens are automatically determined by the coin sensor. Thus, the counting operation needs to be performed only once. In other words, the token-counting can be carried out very efficiently.

According to a second aspect of the present invention, the rotary disk, the disk follower and the endless transfer member are arranged at an upper surface of a main case of the token counter. On the other hand, the guide plate is fixed at a lower portion of an upper casing provided with a token inlet portion open to the upper surface of the rotary disk. The guide passage is formed on a lower side of the guide plate in a downwardly open manner. With such an arrangement, the rotary disk, the disk follower and the endless transfer member are arranged in a plane on the upper side of the main case, with the endless transfer member extending around the circumferences of the rotary disk and the disk follower. Thus, advantageously the tokens on the rotary disk will be smoothly shifted onto the endless transfer member to be transferred and discharged along the guide passage formed in the guide plate arranged at a lower portion of the upper casing.

According to a third aspect of the present invention, in the token counter, the upper casing is attached in a manner enabling opening and closing movement relative to the upper surface of the main case. Further, the upper casing is provided with the coin sensor, while the main case is provided with a light source for the coin sensor. With such an arrangement, maintenance can be readily done merely by opening the upper casing relative to the main case. Thus, it is possible to easily carry out the removing of tokens stuck during the transfer, the changing of the endless transfer member, or the cleaning of the coin sensor or light sources.

According to a fourth aspect of the present invention, in the token counter, the coin sensor serves to distinguish types and numbers of passing-by tokens, while the control unit is arranged to store the types and the numbers of the tokens and calculate them so as to cause a display unit to display a total amount of money. With such an arrangement, even if the supplied tokens are of various types (face values), the total amount for all of the detected tokens can be displayed. Thus, there is no need to add up the amounts of the respective types, which is advantageous for efficiently carrying out the counting operation.

According to a fifth aspect of the present invention, in the token counter, the display unit is arranged to selectively display the total amount of money and data distinguished in accordance with the types of the tokens. With such an arrangement, if the supplied tokens are of various types (face values), the calculated results for the respective types can be known very readily. Thus, it is possible to carry out the entire calculating procedure within a short period of time, which is advantageous for realizing much improved efficiency.

According to a sixth aspect of the present invention, the token counter further includes a rotation direction sensor for detecting a rotational direction of the rotary disk or disk follower. Also, the control unit serves, during a reverse transfer operation of the tokens on the endless transfer member, to prevent calculations for the types and numbers of the tokens from being carried out.

Even if a trouble, such as a jam of tokens in the guide passage, occurs, the jam will advantageously be eliminated by temporarily rotating the rotary disk in the reverse direction. In addition, with the above controlling manner, it is possible to prevent the tokens from being counted again during the backward movement, and also to prevent calculations from being performed for tokens which have not been discharged yet. Thus, the results of calculations will advantageously be accurate.

Further, according to a seventh aspect, in the token counter, an elastic element is arranged adjacent to the coin sensor in the guide passage in facing relation to an upper surface of the endless transfer member.

Such an arrangement is advantageous when tokens carried on the endless transfer member have different thicknesses, and particularly when a comparatively thin token is carried between thicker tokens. This is because the thin token is prevented from laterally deviating by being elastically held between the elastic element and the endless transfer member. In this manner, it is possible to reliably prevent inaccurate results from being obtained in measuring the diameters of the tokens.

BRIEF DESCRIPTION OF DRAWINGS

FIG. 6 is an enlarged sectional view showing principal parts of a coin sensor.

FIG. 7 is a sectional view taken along VII—VII lines in FIG. 6.

FIG. 8(*b*) is a vertical sectional view.

FIG. 11(*b*) is a plan view showing a portion of the rotation direction sensor at the time of a backward rotating operation.

FIG. 11(*c*) is a side view.

DESCRIPTION OF PREFERRED EMBODIMENTS

The present invention may be embodied in a variety of modified and alternative versions, though the drawings show particular examples of embodiments, the details of which will be described below. However, the present invention is not to be limited to these particular embodiments but should be regarded as including all modified and alternative modes contained within the spirit and scope of the present invention defined in the appended claims.

Figure 1:
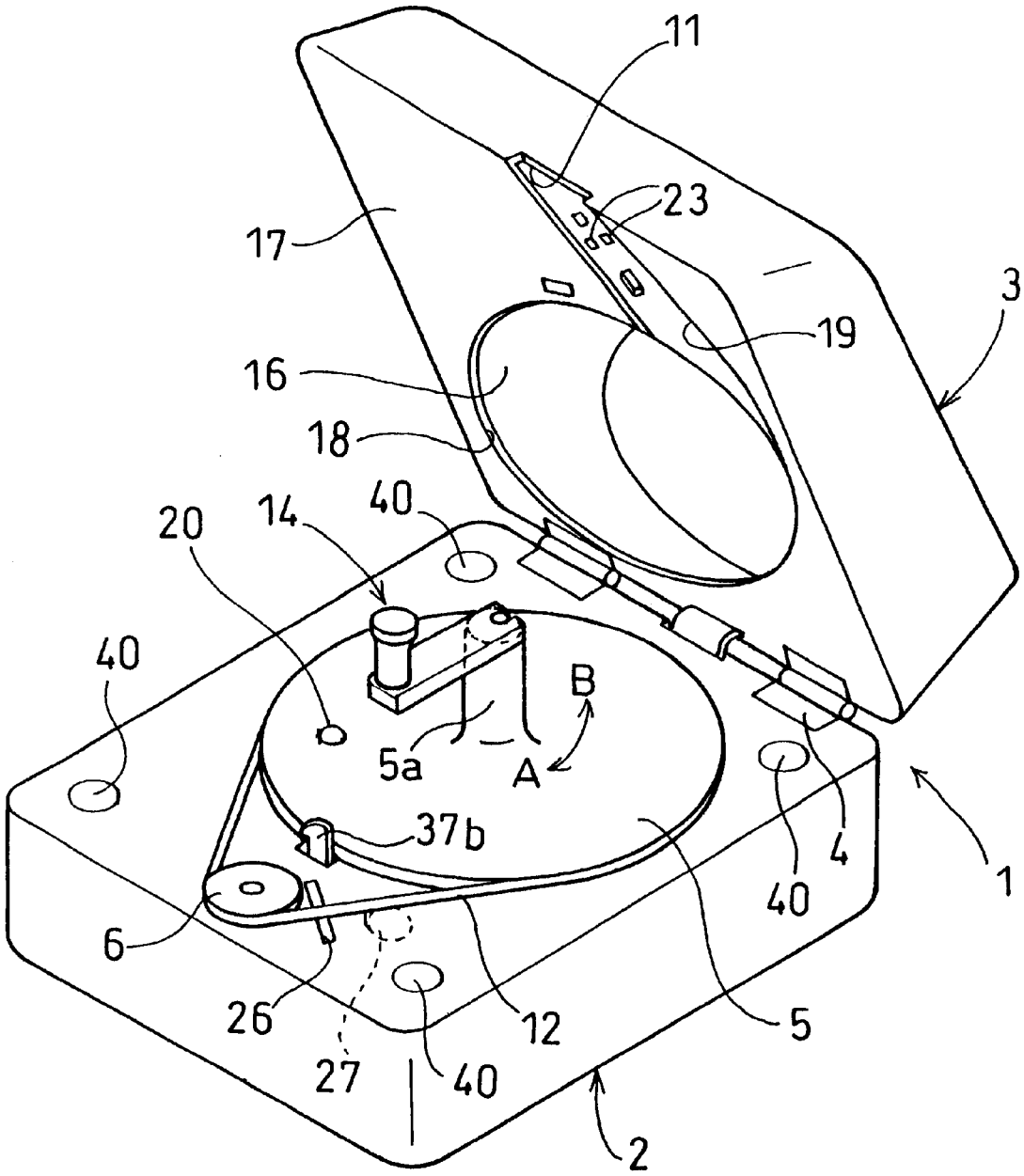
FIG. 1 is a perspective view showing a token counter with its upper casing opened.

As shown in FIG. 1, a counting apparatus 1 according to the present invention is provided with a main case 2, which is made of a synthetic resin and composed of a lower casing 2*a* and a middle casing 2*b* arranged above it. An upper casing 3 and the main case 2 are pivotably connected by hinges 4 at their rear end portions. The upper casing 3 may be releasably attached to the main case 2. A diametrically larger rotary disk 5 and a diametrically smaller disk follower 6 are provided above the middle casing 2*b* in a manner such that they are rotatably supported by vertical shafts 7–8 and bearings 9*a*–9*b*, respectively. The disk follower 6 is disposed at a position close to an outlet 11 of tokens 10 but spaced away from the hinges 4 joining the main case 2 and the upper casing 3. Here, the tokens 10 may be coins (such as 1-yen, 5-yen, 10-yen, 50-yen, 100-yen and 500-yen coins of the Japanese currency) or coin-like pieces used for playing with game machines. It does not make any difference whether they are made of metal or nonmetal (such as ceramic material or synthetic resin).

The circumferential outside surfaces of the rotary disk 5 and disk follower 6 are formed with a groove 13 which is outwardly open and has a generally arcuate configuration to hold an endless transfer member or belt 12 having a circular cross section in a dropout-preventing manner. The belt 12 is arranged to run around the rotary disk 5 and disk follower 6, extending in the grooves 13, 13 of their circumferential outside surfaces. The rotary disk 5 is horizontally and rotatably supported by a plurality of support rollers 15 arranged at positions close to the circumferential edge of the lower surface of the rotary disk.

Figure 2:
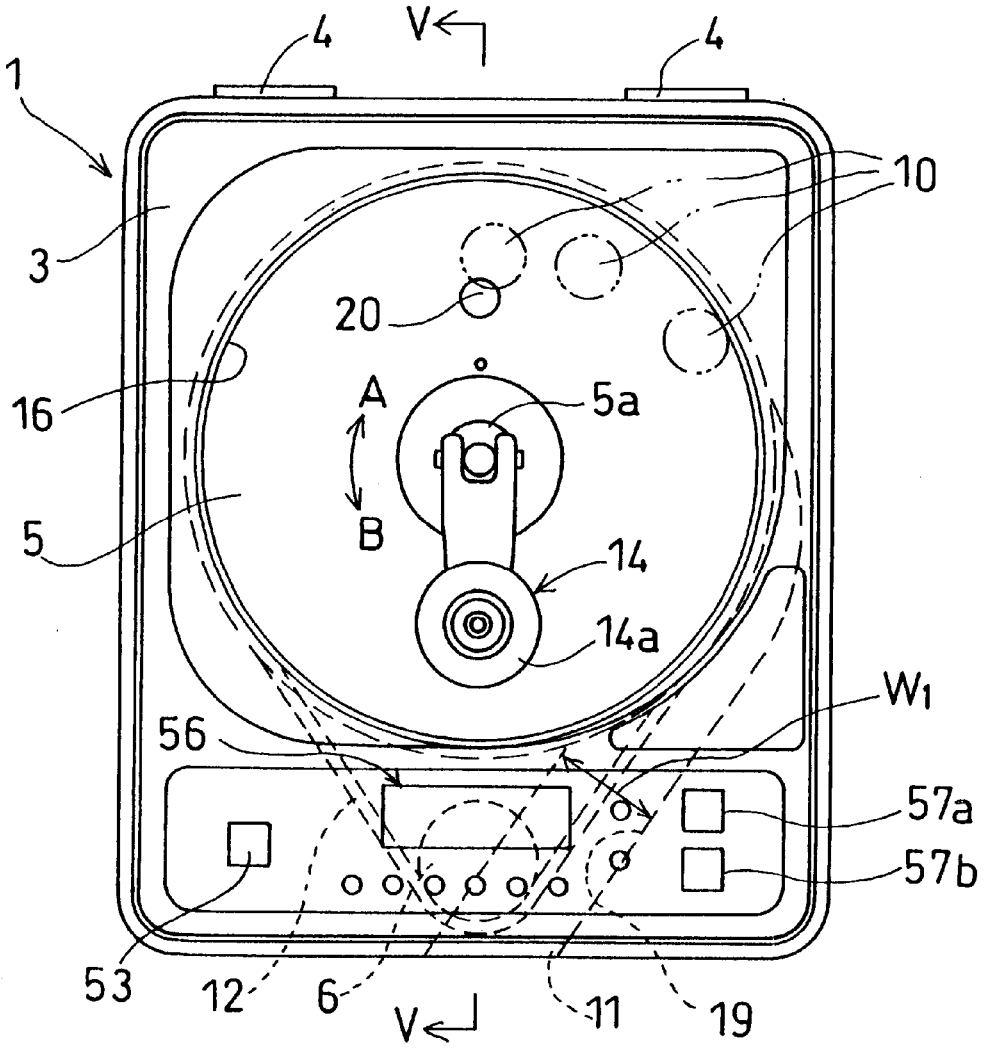
FIG. 2 is a plan view showing the token counter with the upper casing closed.
Figure 3:
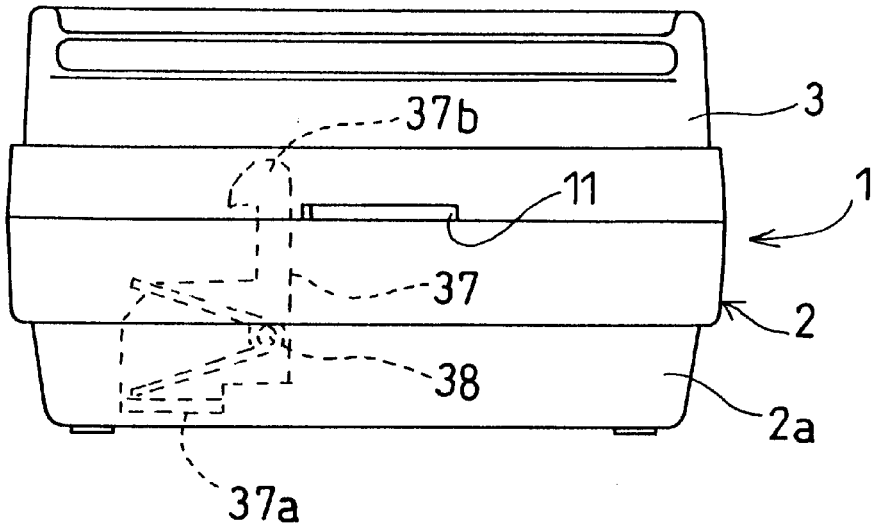
FIG. 3 is a front view showing the token counter.
Figure 4:
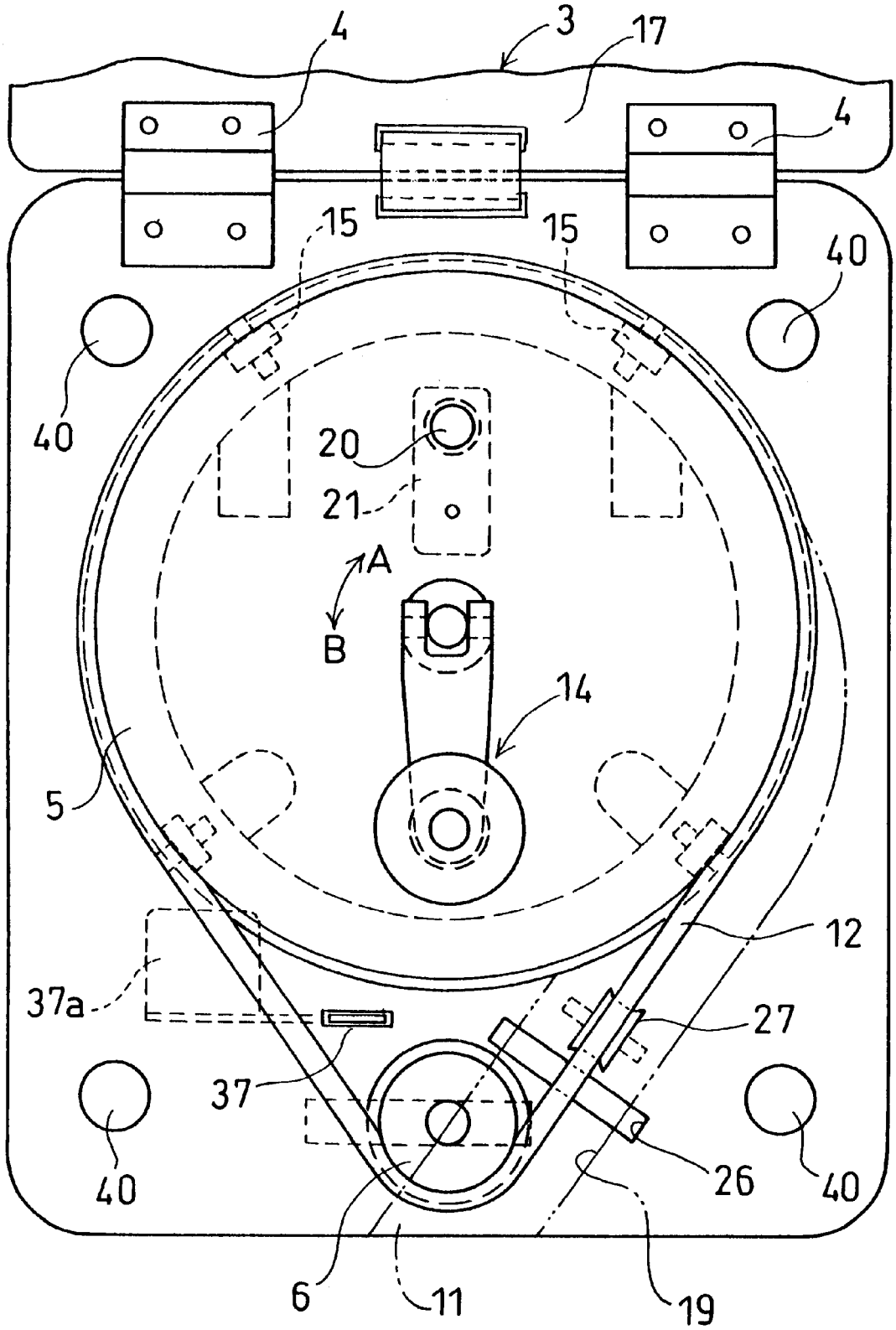
FIG. 4 is a plan view showing a main case with the upper casing opened.
Figure 5:
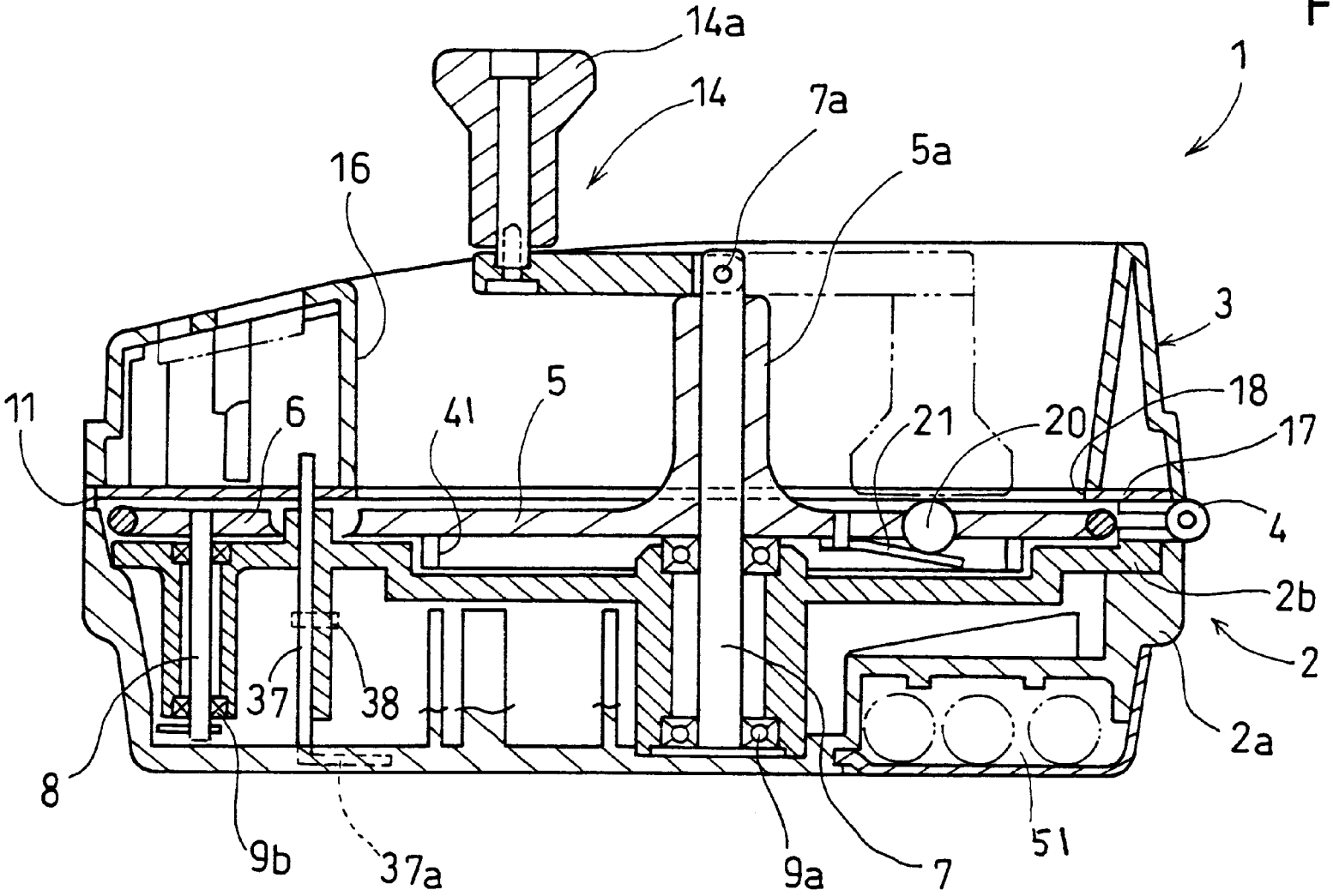
FIG. 5 is an enlarged sectional view taken along V—V lines in FIG. 2.

The center of the obverse surface (upper surface) of the rotary disk 5 is provided with an upwardly extending boss 5*a*, from the upper end of which an upper portion of the shaft 7 protrudes. A handle 14 is connected to the shaft 7 via a pin 7*a* in a vertically pivotable manner. When a grip 14*a* is held in an upright position (see the state depicted in solid lines in FIG. 5), an operator can rotate the handle 14 by manually operating the grip 14*a*. In operation, the rotary disk 5 and the disk follower 6 will be simultaneously rotated via the belt 12. In FIGS. 1, 2 and 4, the arrow A shows a forward direction of rotation, while the arrow B shows a reverse direction of rotation.

The upper casing 2*b* is formed, at its generally central portion, with a circular token inlet portion 16 which is generally equal in diameter to the rotary disk 5 and vertically extends through the upper casing. A metal guide plate 17 having a thickness of about 3 mm is fixed to a lower portion of the upper casing 2*b* by screws (not shown). The guide plate 17 is formed with a circular bore 18 which communicates with the token inlet portion 16 and the upper surface of the rotary disk 5 and is generally equal in diameter to the rotary disk 5. The rotary disk 5, the token inlet portion 16 and the circular bore 18 are concentric.

The guide plate 17 is formed with a downwardly open groove serving as a guide passage 19. As shown in FIGS. 1, 2 and 4, the guide passage, which is arranged to communicate with an outlet 11, receives a part of the belt 12 moving (shifting) from a side portion of the circular bore 18 toward the disk follower 6 when the rotary disk 5 is rotated in the forward direction. The guide passage 19 has a width W1 which is slightly greater than the diametrically greatest token 10 (a 500-yen coin in the Japanese currency for example) placed onto the rotary disk 5. In the present embodiment, the width W1 is equal to 27 mm. Likewise, the depth up to the ceiling of the guide passage 19 is so determined as to allow the passage of the thickest token 10 (a 500-yen coin in the Japanese currency for example) placed onto the rotary disk 5. The belt 12 is arranged to extend along a generally middle line as viewed widthwise of the guide passage 19.

An intermediate portion of the rotary disk 5 is provided with a spherical, stir-facilitating projection 20 arranged to protrude upward (but not to be upwardly removable). The projection 20 has a bottom portion which is elastically supported by a leaf spring 21 attached to the bottom surface (lower surface) of the rotary disk 5. With such an arrangement, the tokens 10 placed on the rotary disk 5 will be properly stirred and prevented from sticking to the obverse surface of the rotary disk 5 in motion, so that they can be readily moved toward the circumference of the rotary disk 5. Further, a token 10 may sometimes be held in an inclining position, with its circumferential portion being put on the projection 20. When such a token, while being rotated, is brought to the inlet of the guide passage 19 (that is adjacent to a portion of the circumferential outside edge of the rotary disk 5), the circumferential portion of the token 10 may come into contact with a ceiling portion of the guide passage 19 adjacent to the inlet. In such an instance, the resilient leaf spring 21 is downwardly bent, thereby causing the projection 20 to be generally flush with the upper surface (obverse surface) of the rotary disk 5. As a result, the token 10 will be rendered generally parallel to the upper surface of the rotary disk 5, which prevents the token 10 from being stuck in the guide passage 19. In this manner, interference of the rotational movement of the rotary disk 5 is avoided, so that the token can be smoothly discharged.

A coin sensor 22 is provided in the guide passage 19 for detecting the diameters and the number of tokens 10 to be carried on the belt 12 moved by the rotary disk 5 rotating in the forward direction. In the present embodiment, a linear CCD sensor (light-detecting means of 2160 pixels, pixel size of 14 $\mu$m×14 $\mu$m, and pitch of 14 $\mu$m) is used for the coin sensor 22. As shown in FIGS. 6 and 7, the line (array) of pixels has a longitudinal direction extending widthwise of the guide passage 19. The coin sensor 22 is fixed to the upper surface of the guide plate 17 by e.g. screws 24, with its detecting surface directed downward. Thus, the detecting surface of the coin sensor 22 faces a pair of right and left detection openings 23, 23 formed in the guide plate 17.

The middle casing **2*b* is provided with a light passage 26 in which light sources 25 are fixed so as to face the detecting surface of the coin sensor 22**. The light sources may be a plurality (three elements arranged in an array in the embodiment) of LEDs (light-emitting diodes).

A presser roller 27 is provided in the main case 2 (the middle casing **2*b*) and located upstream of the transferring path of the tokens 10 from the coin sensor 22 (the light sources 25). The presser roller 27 is supported by a support shaft whose right and left ends are urged by springs 28, so that the belt 12 is elastically pushed upward. With such an arrangement, the tokens 10, which are placed on the belt 12 to be carried thereby, are pressed against the ceiling of the guide passage 19 in the vicinity of the detection openings 23, 23. In this state, the tokens will be moved forward without swaying widthwise of the guide passage 19, so that the diameters of the tokens passing by the detecting surface of the coin sensor 22 can be measured accurately. Thus, it is possible to know the types and the number of the tokens 10. The width (diameter) of a token 10 is determined by the number of pixels shielded from light by the token 10 passing by the detecting surface of the linear CCD sensor or coin sensor 22. The number of the passing tokens 10** is determined by the passage of their diametral portions (the passage is known when the maximum number of the light-shielded pixels begins to reduce).

It should be noted that the belt 12 is arranged to pass under a boarded portion 29 between the paired right and left detection openings 23, 23. In this manner, the token 10 carried on the belt 12 will be held in pressing contact with the ceiling of the guide passage 19 when it comes to the detection openings 23, 23. Thus, its horizontal posture is maintained, so that accurate detection can be performed.

When a plurality of tokens 10 differing in thickness are to be carried on the belt 12, it may happen that a thin token 10 comes after a thick token 10 has passed by the paired right and left detection openings 23, 23 for measurement of the diameter (the type) and the number. In such an instance, the thin token may not be properly pressed against the boarded portion 29 of the ceiling of the guide passage 19, so that it may unduly sway during the transfer. Disadvantageously, this may cause a problem that the detection of the types and the number of the tokens 10 by measuring their diameters fails to produce accurate results.

Figure 8:
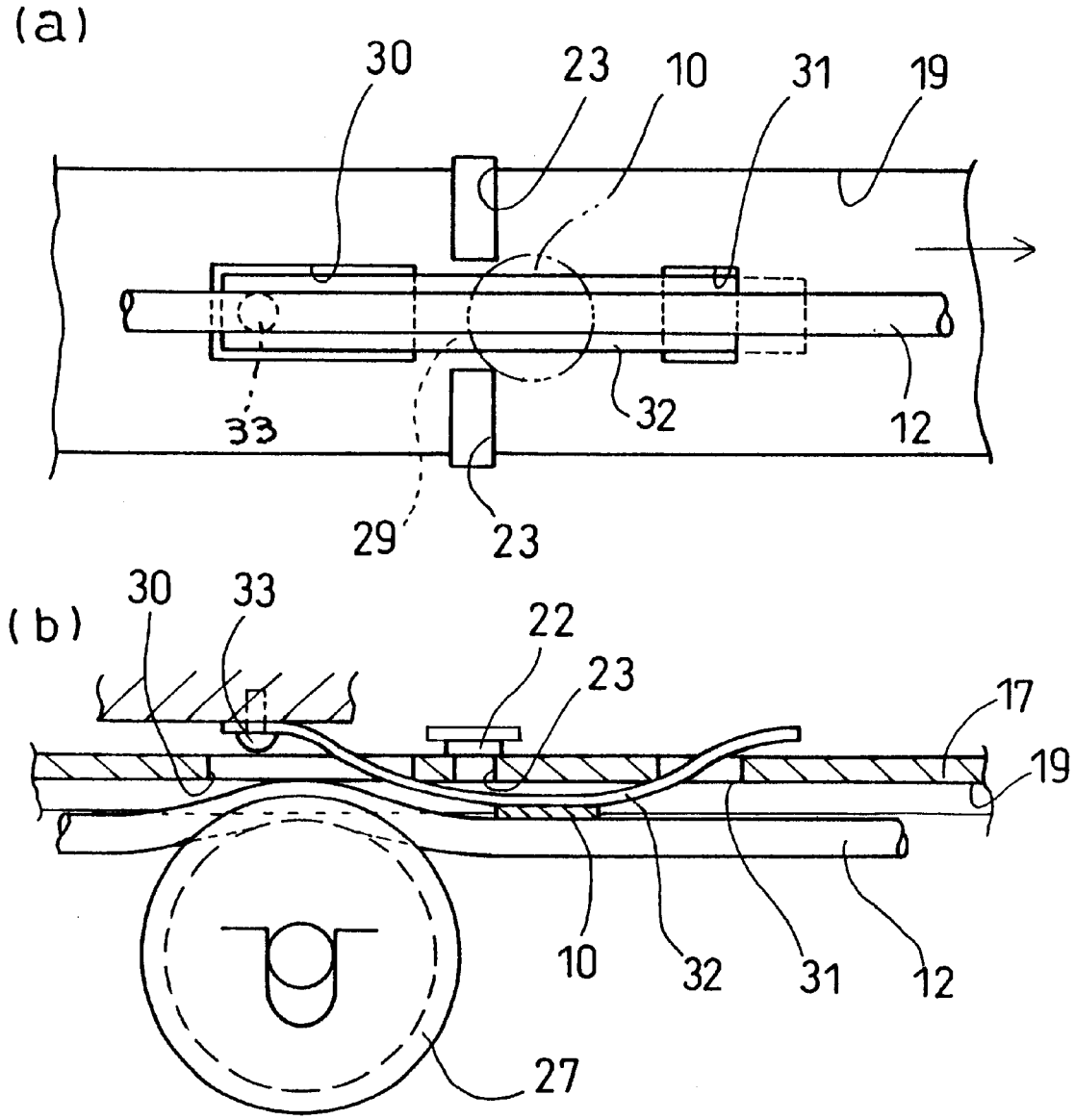
FIG. 8(*a*) is a bottom view showing a modified example of guide passage.

To overcome the above problem, according to an embodiment shown in FIGS. 8(*a*) and 8(*b*), the guide passage 19 is provided with installing holes 30, 31 arranged upstream and downstream of the transferring path of the tokens 10 relative to the boarded portion 29. The installing hole 30 located upstream of the transfer path receives a resilient strip 32 which is made of an elastic and low-friction substance such as PET [poly(ethylene terephthalate)] film and whose base end is fixed by a screw 33. The resilient strip 32 has an intermediate portion extending under the boarded portion 29 and a free end portion extending through the downstream installing hole 31 and terminating above the guide plate 17.

With such an arrangement, even if a token 10 carried on the belt 12 has a small thickness, the upper side of the token 10 is pressed toward the belt 12 by the resilient strip 32, so that the posture of the transferred token 10 is stabilized. As a result, it is possible to improve the measurement accuracy.

As shown in FIGS. 1, 3, 4 and 5, a hooking member 37 is provided which has a top end engaging portion **37*b* protruding above the middle casing 2*b* and an intermediate portion rotatably supported by the middle casing 2*b* via a horizontal shaft 38. A handling portion 37*a* of the hook member is exposed at the bottom surface of the lower casing 2*a*. Further, a torsion spring 39 is provided for urging the top end engaging portion 37*b* of the hooking member 37 in a certain direction. Thus, when the upper casing 3 is closed onto the main case 2, the top end engaging portion is brought into engagement with an engaging hole (not shown) formed in the guide plate 17 serving as a cover for the lower side of the upper casing 3. When the handling portion 37***a* is pushed upward, the top end engaging portion 37*b* will be disengaged from the engaging hole.

Shock-absorbing cushions 40 protrude upward from the upper surface of the middle casing 2*b*. Thus, the guide plate 17 will not bump against the upper surface of the middle casing 2*b* when the upper casing 3 is closed.

Figure 9:
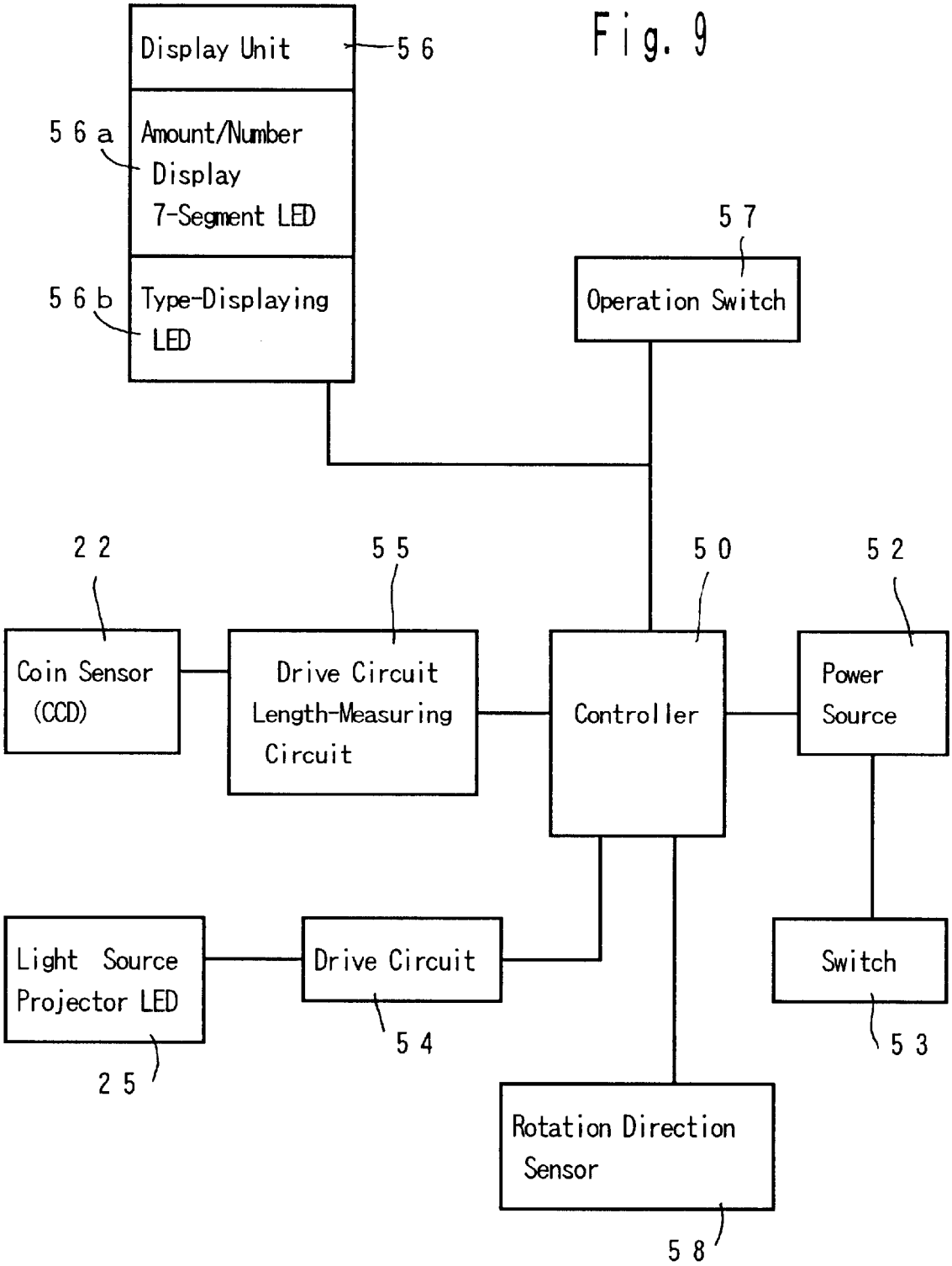
FIG. 9 is a functional block diagram showing a control unit.
Figure 10:
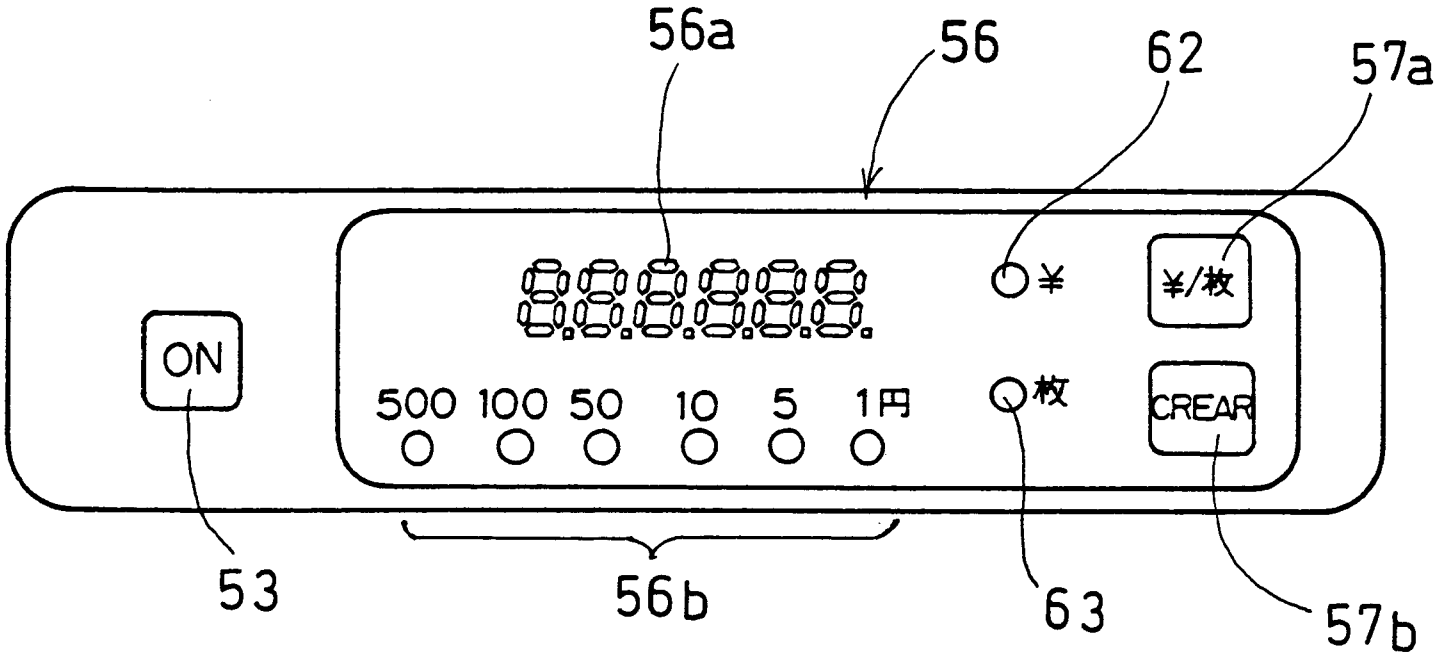
FIG. 10 is a plan view showing a display unit.
Figure 11:
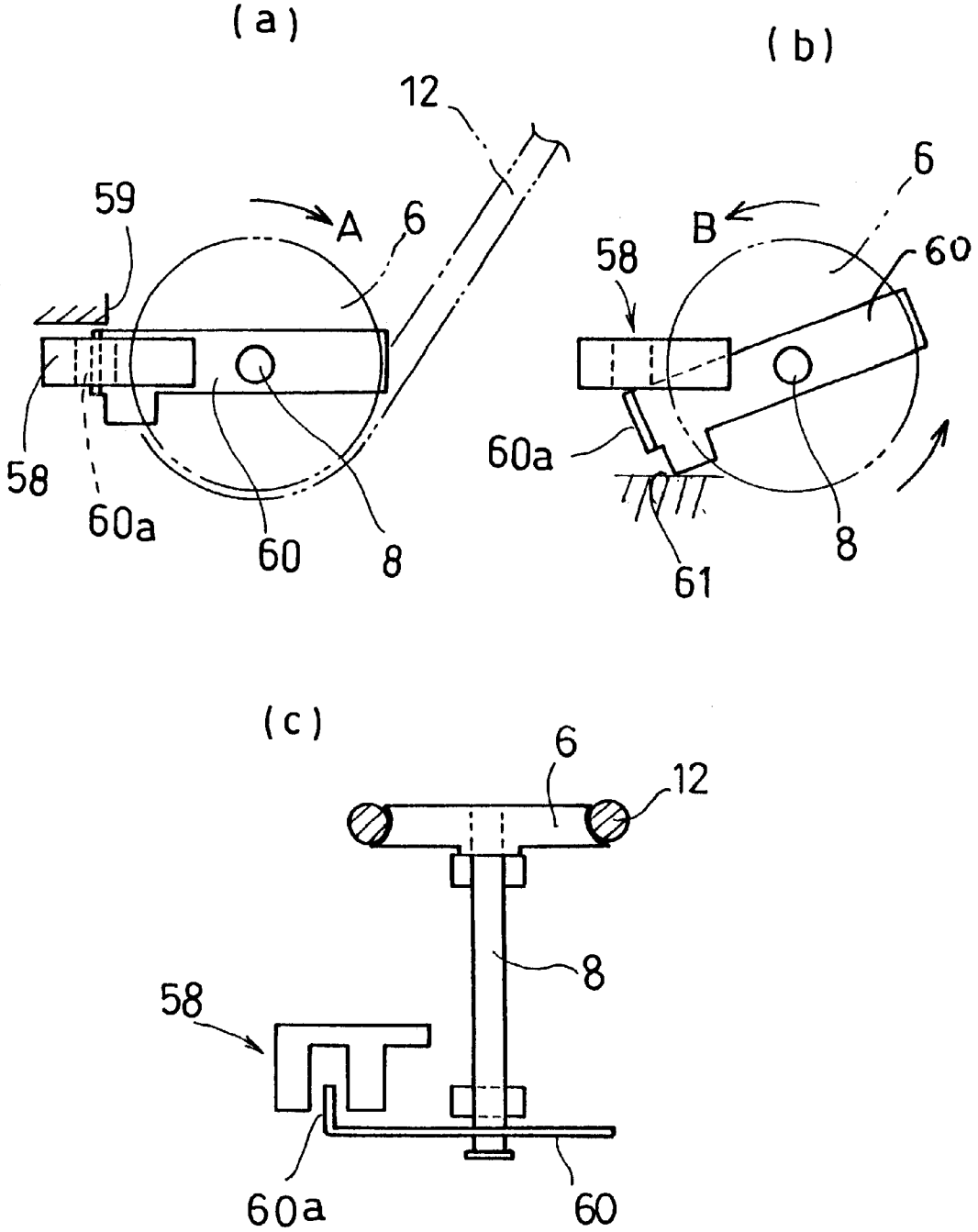
FIG. 11(*a*) is a plan view showing a portion of a rotation direction sensor at the time of a forward rotating operation.

Referring now to FIGS. 9–11, description is made of the measurement control of the token counter 1 of the present invention. FIG. 9 shows a block diagram of the control system. An electronic controlling unit or controller 50, such as a microcomputer, is provided with a CPU capable of performing calculations and control required for displaying the sum of money, the number of coins of each type, or the amount of money for each type of coins. These pieces of information can be selectively displayed through mode selection which will be described later. The controller is also provided with a ROM (read-only memory) to store programs for carrying out the above-mentioned control, and a RAM (random-access memory) to store various data such as the calculated types or sum of the tokens 10. The controller 50 is connected to a power source 52 such as dry cells accommodated in a battery holder 51 provided at a lower portion of the main case 2, while also connected to a power-supply switch 53, a drive circuit 54 for the light sources 25 consisting of LEDs as projectors, a length-measuring circuit including a drive circuit for the coin sensor 22, a display unit 56, operation switches 57 for this unit and a rotation direction sensor 58 described later.

The power-supply switch 53, the display unit 56 and the operation switches 57 are arranged in a front region of the upper surface of the upper casing 3, as shown in FIGS. 2 and 10. The enlarged view of FIG. 10 shows that the display unit 56 is provided with 7-segment LEDs 56*a* serving as numerical display means for indicating the calculated amount or number of the tokens 10 and also with other LEDs 56*b* serving as coin type display means for indicating the types of the calculated tokens 10 (the 1-yen, 5-yen, 10-yen, 50-yen, 100-yen and 500-yen coins for the Japanese currency). The above-mentioned operations switches includes a mode changeover switch 57*a* to be pressed for selectively indicating the resulting Yen/Number information, for the respective types, which has been obtained from the calculation of the unassorted tokens 10, and also includes a clear switch 57*b* for terminating the indication mode for the type-distinguished calculation results.

The rotation direction sensor 58 is arranged to detect whether or not the operator causes a token 10 to be moved in the backward direction after the token 10, which is transferred on the belt 12 associated with the disk follower 6, has passed by the coin sensor 22 to advance toward the outlet 11. Such detection leads to control whereby data about the backwardly transferred token 10, among the results obtained from the coin sensor 22, will be ignored (cleared). The rotation direction sensor 58, which may be made up of a light sensor such as a photo interrupter, is arranged to detect the presence or absence of a detection element 60 which is supported on a lower end of the shaft 8 of the disk follower 6 and rotatable together with the shaft, as shown in FIGS. 11(*a*), 11(*b*) and 11(*c*). Based on such detection, it is determined whether the rotation is being made forward or backward. Specifically, when the disk follower 6 (the rotary disk 5) is rotated forward or in the direction of arrow A (see FIG. 11(*a*)), the detection element 60 rotatable with the shaft 8 is stopped by a stopper member 59 (a predetermined portion of the middle casing 2*b*), thereby causing a detection part 60*a* to shield the light of the rotation direction sensor 58. Thus, a predetermined signal is generated, and calculations described below will be carried out based on the measurements obtained by the coin sensor 22. Conversely, when the disk follower 6 (the rotary disk 5) is rotated backward or in the direction of arrow B (see FIG. 11(*b*)), the rotatable detection member 60 is stopped by another stopper member 61 (or brought into engagement with an inner wall portion of the lower casing 2*a*), thereby allowing the detection part 60*a* to pass the light of the rotation direction sensor 58. Thus, a predetermined signal is generated for causing the measurements obtained from the coin sensor 22 to be ignored.

Next, the function and operation of the token counter 1 will be described. When the upper casing 3 is closed onto the main case 2, and the grip 14*a* of the handle 14 is moved to take the upright position, a plurality of tokens 10 to be calculated are put into the token inlet portion 16 of the upper casing 3, with their types (1-yen, 5-yen, 10-yen, 50-yen, 100-yen and 500-yen coins) unassorted. When the power supply switch 53 is turned on, the 7-segment LEDs 56*a* of the display unit 56 are illuminated to display "0." A money amount lamp 62 may be turned on at this stage.

Then, when the handle 14 is turned in the direction of arrow A in FIG. 2 (forward rotation), the rotary disk 5 is rotated in the direction of arrow A, thereby causing the tokens 10 on the rotary disk 5 to be introduced, one by one in a linearly extending manner, into the guide passage 19. Within the guide passage 19, the tokens 10 are carried on the belt 12 to be transferred forward in the direction of the outlet 11. Since the belt 12 is urged from below by the presser roller 27 when it comes in the vicinity of the coin sensor 22. Thus, the tokens 10 will be transferred while being pressed against the ceiling surface of the guide passage 19. When brought to the coin sensor 22, passing tokens 10 shield part of the light emitted from the light sources 25 arranged below. Thus, the diameters of the passing tokens 10 are measured by the coin sensor 22 to determine the types of the tokens. Further, since the passage of their diametral portions is detected by the coin sensor 22, the number of the tokens 10 to be carried out (discharged) is calculated. Sets of data each of which includes information about a coin type and information about the number of discharged tokens of the coin type, data about the total number of the carried-out tokens, and data about the total amount of money of the discharged tokens are transmitted from the drive circuit 55, which is provided with the length-measuring circuit, to the controller 50. The respective data are stored in the RAM.

More specifically, for instance, an unassorted set of five 1-yen tokens (coins) 10, three 5-yen tokens (coins) 10 and seven 100-yen tokens (coins) 10 may be put into the inlet portion 16 and then the rotary disk 5 is rotated in the forward direction. Whenever a 1-yen token (coin) 10 passes by the coin sensor 22, 1 is added and stored in a 1-yen memory region of the RAM. Thus, when the five tokens have passed, the amount of money to be stored is 5 yen, and the number to be stored is 5. Likewise, whenever a 5-yen token (coin) 10 passes by the coin sensor 22, 1 is added and stored in a 5-yen memory region of the RAM. Thus, when the three tokens have passed, the amount of money to be stored is 15 yen, and the number to be stored is 3. Further, a 100-yen token (coin) 10 passes by the coin sensor 22, 1 is added and stored in a 100-yen memory region of the RAM. Thus, when the seven tokens have passed, the amount of money to be stored is 700 yen, and the number to be stored is 7. Consequently, a total amount memory region stores 720 yen which is equal to 5 yen+15 yen+700 yen.

Thus, as the discharging operation of the tokens 10 is being continued after the switch is pressed, the 7-segment LEDs 56*a* of the display unit 56 displays the numerical information about the total amount of money for the discharged tokens 10. In the above example, the 7-segment LEDs 56*a* will display the value 720.

After the discharging operation of the tokens 10 is completed, the mode changeover switch 57*a* may be pressed once. Then, the money amount lamp (LED) 62 shown in FIG. 10 is turned on, and in this state, the coin type display LEDs 56*b* are turned on one by one for a suitable period of time in the descending order of value (500 yen→1 yen). Corresponding to the types of the respective discharged tokens 10, the amount of money is displayed by the 7-segment LEDs 56*a*. Thus, in the above-described example, the display LED 56*b* assigned for the 100-yen type is turned on for a predetermined period of time and coincidentally the 7-segment LEDs 56*a* display "700." Then, the display LED 56*b* assigned for the 5-yen type is turned on for a predetermined period of time and coincidentally the 7-segment LEDs 56*a* display "15." The display LED 56*b* assigned for the 1-yen type is turned on for a predetermined period of time and coincidentally the 7-segment LEDs 56*a* display "5."

When the mode changeover switch 57*a* is pressed once again, a number lamp (LED) 63 shown in FIG. 10 is turned on. In this state, the coin type display LEDs 56*b* are turned on one by one for a suitable period of time in the descending order of value (500 yen→1 yen). Corresponding to the types of the respective discharged tokens 10, the number is displayed by the 7-segment LEDs 56*a*. Thus, in the above-described example, the display LED 56*b* assigned for the 100-yen type is turned on for a predetermined period of time and coincidentally the 7-segment LEDs 56*a* display "7." Then, the display LED 56*b* assigned for the 5-yen type is turned on for a predetermined period of time and coincidentally the 7-segment LEDs 56*a* display "3." The display LED 56*b* assigned for the 1-yen type is turned on for a predetermined period of time and coincidentally the 7-segment LEDs 56*a* display "5."

It is also possible to make arrangements so that, after the discharging operation of the tokens 10 is completed, the coin type display LEDs 56*b* are turned on, one by one, in a shifting manner as 500 yen→100 yen→50 yen→10 yen→5 yen 1 yen, at each pressing operation of the mode changeover switch 57*a*, while simultaneously the calculated amount of money or number of tokens is displayed.

When the clear switch 57*b* is pressed, the indication mode for the type-distinguished calculation results is terminated to be switched to a total amount display mode.

If the operator turns the handle 14 backward (in the direction of arrow B shown in FIG. 2) during the calculating operation of the tokens 10, tokens 10 carried on the belt 12 in the guide passage 19 are transferred backward toward the rotary disk 5. This may need to be carried out when tokens 10 are stuck in the guide passage 19 or at the time of other operational malfunctions. When the above backward operation (the backward transfer operation of the tokens 10) is carried out in an instance where a forwardly transferred token 10 has been counted by the coin sensor 22 but not discharged yet, the once-counted token 10 will pass by the coin sensor 22 reversely, and the rotation direction sensor 58 will output a detection signal for the reverse operation. In response to the detection signal, control may be performed for ignoring the data of the last measurement carried out during the forward passing movement. Alternatively, subtraction may be carried out for the number (1) added in the type-distinguishing manner, and the relevant value may be subtracted from the total amount of money.

It may also happen that a token 10 is stopped at the location of the coin sensor 22 during the forward transfer operation. In this case, the measurement of the diameter of the token 10 is incomplete, and the passage-counting for the particular token 10 has not been done yet. Thus, when it is found that the reverse transfer operation is being performed, preferably an error message may be displayed for calling the operator's attention to the error and implying that the measurement of the tokens 10 needs to be performed again from the beginning.

It should be appreciated that, according to the present invention, maintenance can be readily done merely by opening the upper casing 3 relative to the main case 2. Thus, it is possible to easily carry out the removing of the tokens 10 stuck during the transfer, the changing of the belt 12, or the cleaning of the coin sensor 22 or light sources 25.

A photosensor capable of detecting variations in amount of light may be used for the coin sensor 22 in place of the CCD sensor. Further, in place of the handle 14 used for manually rotating the rotary disk 5, use may be made of a non-illustrated, reversible drive motor arranged in the main case 2. In this case, the lower surface of the rotary disk 5 may be provided with a gear portion 41 (see FIG. 5), and driving power is supplied to the gear portion 41 to cause the rotary disk 5 to rotate. Still further, a cover member may be put over the token counter 1 when unused, so that dust is prevented from gathering on the upper casing 3, particularly in the token inlet portion 16.

As long as tokens 10 have different diameters depending on their types, the present invention may readily be applied to an instance where foreign coins need to be counted. Based on the measurement of the diameters of the tokens 10 with the use of the coin sensor 22, it is possible to distinguish the types of the tokens 10 and calculate the number thereof.

What is claimed is:

1. A token counter comprising:

a rotary disk supported for rotation and having an upper surface for supporting tokens;

a disk follower arranged outwardly from the rotary disk;

an endless transfer member extending around the rotary disk and the disk follower;

a guide plate provided with a token inlet portion open to the upper surface of the rotary disk, the guide plate being also provided with a guide passage for guiding tokens toward an outlet, the tokens being carried on the endless transfer member moving from a circumferential portion of the rotary disk toward the disk follower;

a coin sensor for detecting diameters and transmit the number of the tokens being transferred in the guide passage;

a control unit for calculating measurement results obtained by the coin sensor;

a display unit for displaying calculated results; and a rotation direction sensor for detecting a rotational direction of the rotary disk or disk follower;

wherein the control unit serves, during a reverse transfer operation of the tokens on the endless transfer member, to adjust the calculation when a once-counted token moves backwardly past the coin sensor.

2. The token counter according to claim 1, wherein the rotary disk, the disk follower and the endless transfer member are arranged at an upper surface of a main case; and wherein the guide plate is fixed at a lower portion of an upper casing provided with a token inlet portion open to the upper surface of the rotary disk, the guide passage being formed on a lower side of the guide plate in a downwardly open manner.

3. The token counter according to claim 2, wherein the upper casing is attached in a manner enabling opening and closing movement relative to the upper surface of the main case, the upper casing being provided with the coin sensor, the main case being provided with a light source for the coin sensor.

4. The token counter according to claims 1, 2 or 3, wherein the coin sensor serves to distinguish types and numbers of passing-by tokens, the control unit being arranged to store the types and the numbers of the tokens and calculate them so as to cause the display unit to display a total amount of money.

5. The token counter according to claims 1, 2 or 3, wherein the display unit is arranged to selectively display the total amount of money and data distinguished in accordance with the types of the tokens.

6. The token counter according to claims 1, 2 or 3, wherein an elastic element is arranged adjacent to the coin sensor in the guide passage in facing relation to an upper surface of the endless transfer member.

7. The token counter according to claim 4, wherein the display unit is arranged to selectively display the total amount of money and data distinguished in accordance with the types of the tokens.

8. The token counter according to claim 4, wherein an elastic element is arranged adjacent to the coin sensor in the guide passage in facing relation to an upper surface of the endless transfer member.

9. The token counter according to claim 5, wherein an elastic element is arranged adjacent to the coin sensor in the guide passage in facing relation to an upper surface of the endless transfer member.

* * * * *